US010603526B1

(12) United States Patent
Leger

(10) Patent No.: US 10,603,526 B1
(45) Date of Patent: Mar. 31, 2020

(54) FIRE PROTECTIVE HEADGEAR

(71) Applicant: Christopher J. Leger, Southampton, NJ (US)

(72) Inventor: Christopher J. Leger, Southampton, NJ (US)

( * ) Notice: Subject to any disclaimer, the term of this patent is extended or adjusted under 35 U.S.C. 154(b) by 268 days.

(21) Appl. No.: 15/469,216

(22) Filed: Mar. 24, 2017

Related U.S. Application Data

(60) Provisional application No. 62/320,832, filed on Apr. 11, 2016.

(51) Int. Cl.
*A62B 17/00* (2006.01)
*A62B 17/04* (2006.01)

(52) U.S. Cl.
CPC ..... *A62B 17/003* (2013.01); *A62B 17/04* (2013.01)

(58) Field of Classification Search
None
See application file for complete search history.

(56) References Cited

U.S. PATENT DOCUMENTS 3,557,410 A * 1/1971 Van Buren ..... A41F 11/04 24/474
4,174,710 A * 11/1979 Pampuch ..... A62B 18/08 128/206.24
5,542,128 A * 8/1996 Lomas ..... A61M 16/0683 128/207.11
D383,204 S * 9/1997 Lomas ..... D24/110
6,328,031 B1 * 12/2001 Tischer ..... A62B 17/04 128/201.22
8,839,788 B2 * 9/2014 Betz ..... A62B 9/04 128/206.19

* cited by examiner

*Primary Examiner* — Anna K Kinsaul
(74) *Attorney, Agent, or Firm* — Frost Brown Todd LLC

(57) ABSTRACT

The present invention provides fire protective headgear that is capable of being put on and taken off quickly. The headgear has a face mask with a transparent visor connected to a surrounding flexible flange. A cap formed with a rear gap is attached to the flange with straps. A hood has a lip for sealing to the flange. A series of fasteners is assembled around the flange and a series of mating fasteners is assembled around the hood. To put the headgear on, the hood is draped forward over the face mask, the cap is draped over the hood, and the face mask is placed onto the firefighter's face. The cap is moved to cover the back of the firefighter's head and the hood is moved to cover the cap and cover the neck and shoulders of the firefighter.

9 Claims, 3 Drawing Sheets

FIRE PROTECTIVE HEADGEAR

RELATED APPLICATION

This application is a conversion and retains priority of provisional patent application No. 62/320,832 filed Apr. 11, 2016.

FIELD OF THE INVENTION

The present invention relates to the field of protective garments worn by firefighters, and more particularly to fire protective headgear.

BACKGROUND OF THE INVENTION

Firefighters face danger and personal injury every time they enter a building in the process of attempting to extinguish a fire. The fire presents several types of danger to the firefighter including extreme heat, toxic smoke and low visibility as well as the instability of the structure of a burning building. All of these hazards regularly cause fire fighters injury and loss of life.

Modern engineering efforts and materials are being used to improve the protection afforded to firefighters while battling a blaze. Firefighters entering a burning building today wear a face mask having internal filters to reduce the inhaled fumes and a connection port for a fresh air hose. Firefighters also wear a flame blocking hood made of Nomex® aramid fiber, the hood being formed to overlap the edges of the face mask to create a fully protective barrier. Other articles of clothing worn by firefighters, e.g. jackets and trousers, are similarly designed and manufactured to provide thermal insulation and minimize the incidence of injury and death.

However, in many situations the firefighter must put on the protective headgear quickly. More importantly, in cases when the firefighter has been hurt or the face mask has been damaged, the protective headgear has to be removed quickly and easily in order to care for the firefighter. The presently known face masks and hoods are held to the firefighter's head with straps that must be adjusted to a proper fit. Removing these face masks requires removing the hood and then loosening or cutting as many as 5 straps, costing precious time. The invention described below provides a novel and improved fire protective headgear that is capable of being put on and taken off more quickly than previous types, thereby enhancing the safety of the firefighter.

SUMMARY OF THE INVENTION

The fire protective headgear provided includes a face mask having a transparent visor with a connected flexible flange. The flange has a series of fasteners mounted peripherally thereto. A cap having a gap formed between left and right rear portions is connected to the flange with adjustable straps. A releasably connectable strap is provided to connect the rear portions of the cap. A hood configured for covering the head, neck and shoulders of the firefighter has a series of fasteners formed for engaging the fasteners on the flange, thereby mounting the hood to the face mask. To put on the headgear of the invention, the hood, being connected to the face mask, is pulled forward over the face mask and the cap is pulled forward over the hood. The face mask is placed against the face of a firefighter and the cap is moved to cover the back of the firefighter's head with the cap straps connected. Next the hood is moved over the cap to cover the head, neck and shoulders of the firefighter. Finally, the firefighter puts on a jacket that overwraps the lower portions of the hood to provide a fire protective enclosed garment. Removal of the fire protective headgear involves essentially reversing the procedure.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
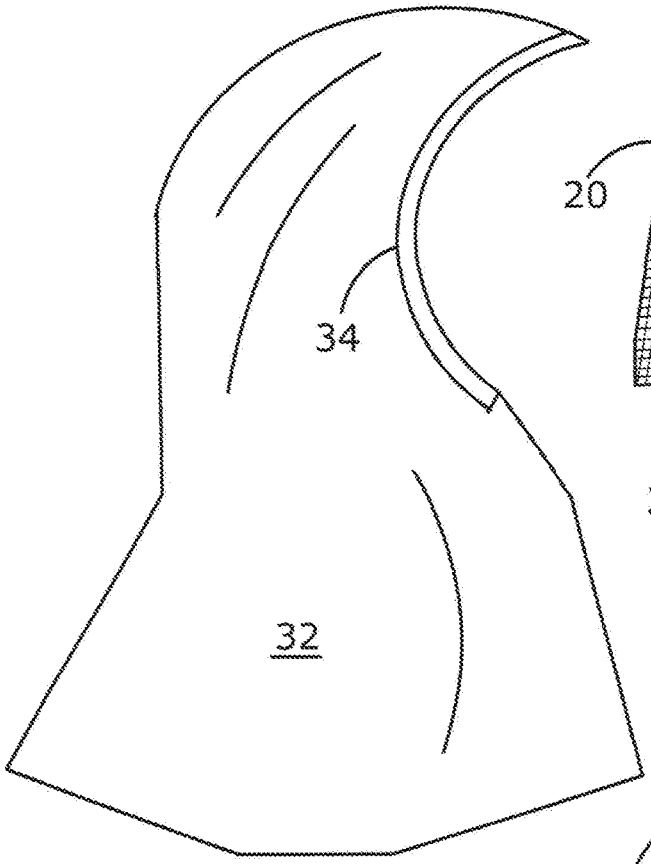
Fig. 1 PRIOR ART
FIG. 1 is an exploded side elevation view of a hood and face mask according to the prior art.
Figure 1:
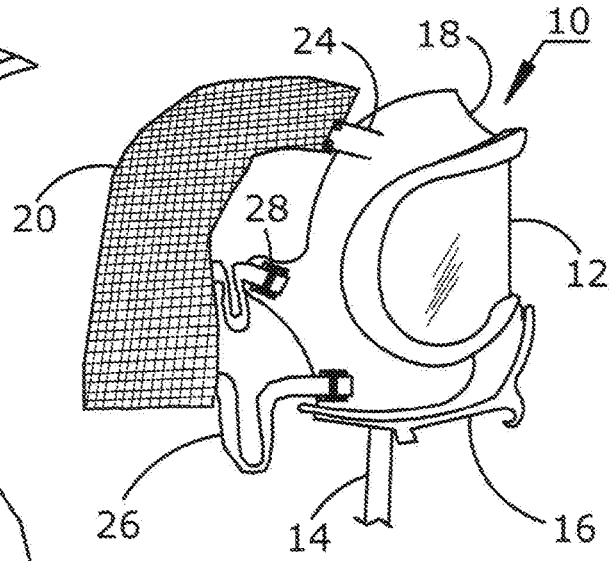
Fig. 1 PRIOR ART

Referring to FIG. 1, a typical set of fire protective headgear of the prior art is illustrated in exploded side elevation view with a hood 32 positioned for assembly to a face mask 10. Face mask 10 has a flange 18 formed of a molded high temperature resistant flexible material, e.g. modified neoprene resin, and a transparent visor 12 formed of a high temperature resistant rigid material, e.g. polycarbonate resin. Flexible flange 18 is configured to conform and seal around the face of the firefighter. Face mask 10 has a loop 14 to be placed around the neck of the firefighter to prevent face mask 10 from being lost when it is removed from the firefighter's head. A receptor socket 16 is formed at the bottom of face mask 10 for connecting a source of fresh air, e.g. a hose connected to a compressed air tank (not shown). A cap 20, made of a fire resistant material, e.g. woven Nomex® fiber, is positioned to cover the back of the firefighter's head. Once cap 20 is in position, a set of straps 26 are tightened through buckles 28 to secure face mask 10 and cap 20 to the head of the firefighter. An upper strap 24 may be of fixed length and not require tightening to adjust face mask 10 to the head of the firefighter.

Figure 2:
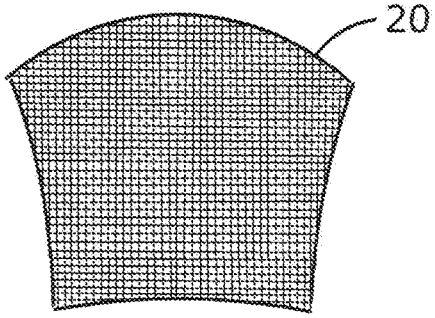
FIG. 2 is a rear elevation view of a cap portion of a face mask according to the prior art.

Referring now to FIG. 2, cap 20 is shown in rear elevation view. Cap 20 of the prior art fully covers the top and the back of the firefighter's head and extends downward to cover the neck area.

Figure 3:
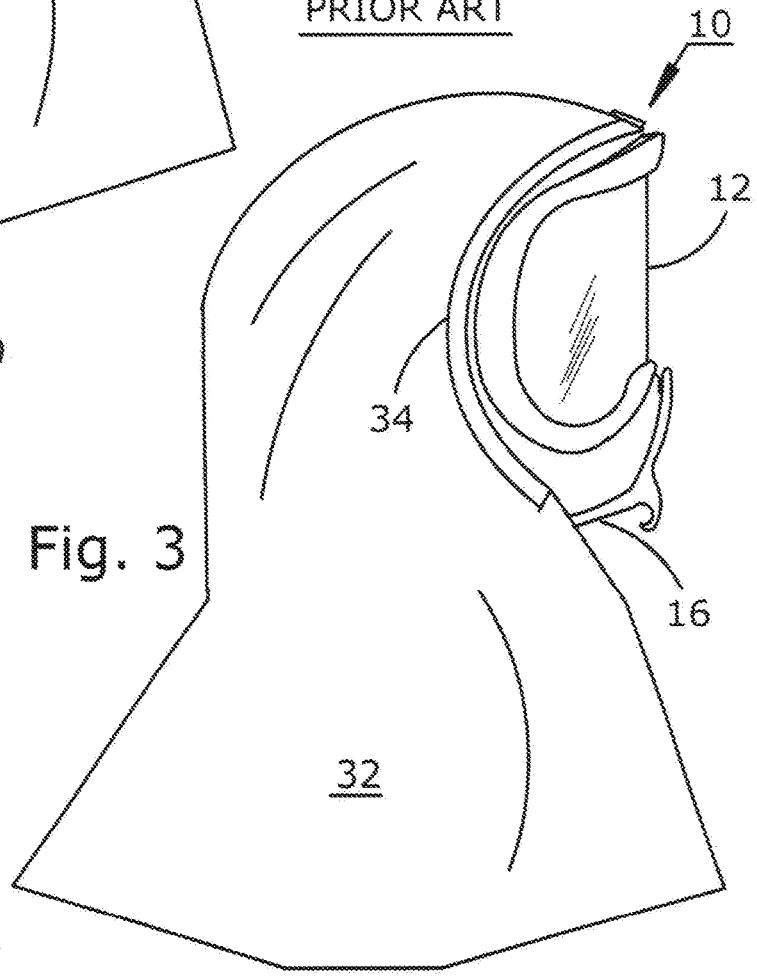
Fig. 3 PRIOR ART
FIG. 3 is a side elevation view of a fully assembled hood and face mask according to the prior art.

Referring now to FIG. 3, after face mask 10 and cap 20 (see FIG. 1) have been secured to the head of the firefighter, hood 32 is passed over the head and secured with a snugly fitting lip 34 in intimate contact with flange 18 (see FIG. 1)

to prevent infiltration of heat and smoke. Hood 32 is formed of a heat and flame resistant fiber, e.g. woven Nomex® aramid fiber. The lower portion of hood 32 covers the firefighter's neck and shoulders and is to be overlaid by a firefighter's protective jacket, the jacket being put on after the headgear. In emergency situations that tend to be dealt with regularly by firefighters, putting on fire protective clothing, especially headgear, must be done as quickly as possible. Also, there are cases when a firefighter may fall and be injured while inside a burning building, causing damage to the face mask and potentially allowing toxic fumes to be inhaled by the firefighter. The firefighter or a rescue worker must be able to remove the damaged face mask from the firefighter quickly and provide a source of clean air. The need to disconnect multiple adjustable straps to release and remove the face mask delays the delivery of life-saving clean air to the firefighter.

Figure 4:
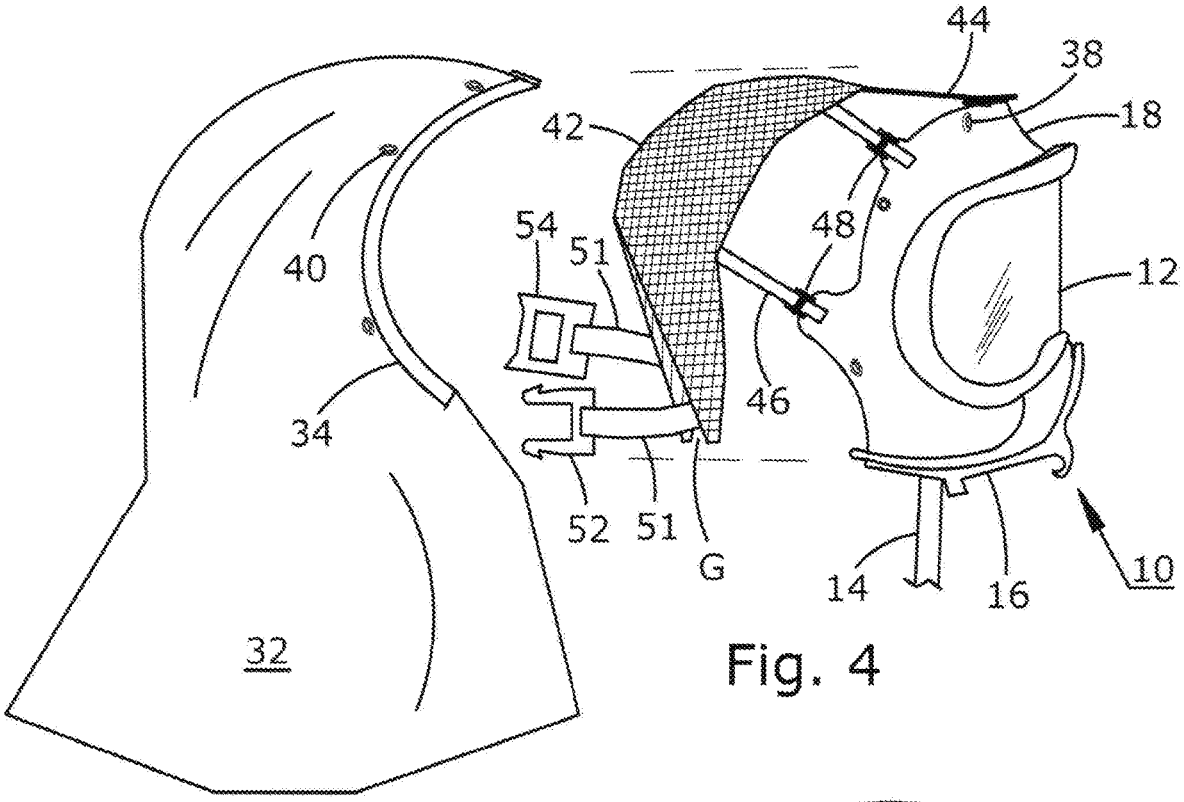
FIG. 4 is an exploded side elevation view of a hood and face mask according to the present invention.

Referring now to FIG. 4, an embodiment of the present invention fire protective headgear is illustrated in exploded side elevation view with a hood 32 positioned for assembly to a face mask 10. The invention disclosed is designed to enable a firefighter to quickly and efficiently put on and remove the fire protective headgear. Hood 32 is formed with a lip 34 that snugly fits to face mask 10 to engage a flange 18. Face mask 10 is a modification of the type face mask that is currently known, with visor 12 and flange 18 substantially as described above in relation to the prior art. A series of reconnectable fasteners 38 are mounted peripherally around flange 18. An upper central strap 44 may be of a fixed length to connect flange 18 to cap 42. Additional straps 46 are engaged with buckles 48 to be adjusted to fit the head of the firefighter. Cap 42 is formed with a gap G between separated lower rear sections so as to be open at the back of the head of the firefighter in order to accommodate various head sizes or protruding hair configuration, e.g. a bun. A separable buckle set consists of a resilient spade 52 configured to be inserted into a socket 54 to secure cap 42 in position. When spade 52 is engaged with socket 54, gap G remains open with the opposed lower rear sections of cap 42 remaining separated. Alternate forms of separable buckle sets are considered within the scope of the invention. The novel configuration of cap 42 with gap G allows straps 51 to remain in their adjusted lengths, relying only on buckle set 52, 54 to fasten and remove cap 42 from the head of the firefighter.

Referring further to FIG. 4, hood 32 is formed with a series of reconnectable fasteners 40 that are configured to engage fasteners 38 on flange 18 of face mask 10. The engageable fasteners 38, 40 allow hood 32 to remain connected to face mask 10 while face mask 10 is being put on and taken off as will be described below. Fasteners 38, 40 may be snap fasteners as are known. As will be understood by those skilled in the pertinent art, all components of fire protective gear must be fire resistant, heat tolerant, and either highly insulating or positioned to avoid direct contact with the skin. Fasteners 38, 40 are preferably molded of a synthetic resin or, if metallic, an internal insulating flap is provided to keep fasteners 38 from contacting the skin. A satisfactory snap fastener available from YKK North America is molded of high temperature nylon resin that has been tested as capable of surviving a temperature of 1500° F. for 60 seconds.

Figure 5:
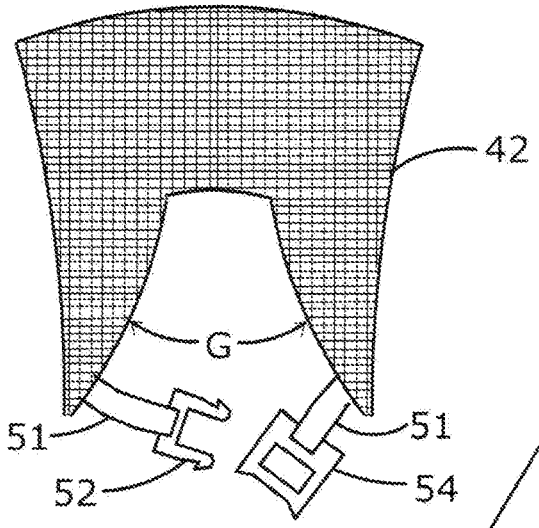
FIG. 5 is a rear elevation view of a cap portion of a face mask according to the present invention.

Referring now to FIG. 5, cap 42 is shown in rear elevation view. Cap 42 is seen with gap G formed between left and right rear portions and is provided with straps having resilient spade 52 and socket 54 buckle set for closure when face mask 10 (see FIG. 4) is being worn. Gap G provides the ability to adapt the fire protective headgear to be worn by firefighters with various size heads. Additionally, gap G is adaptable to a firefighter having with a pony tail or bun style hairdo. When quickly putting on and taking off face mask 10, engaging and disengaging buckle set 52, 54 provides an improvement in speed over prior known fire protective headgear apparatus.

Figure 6:
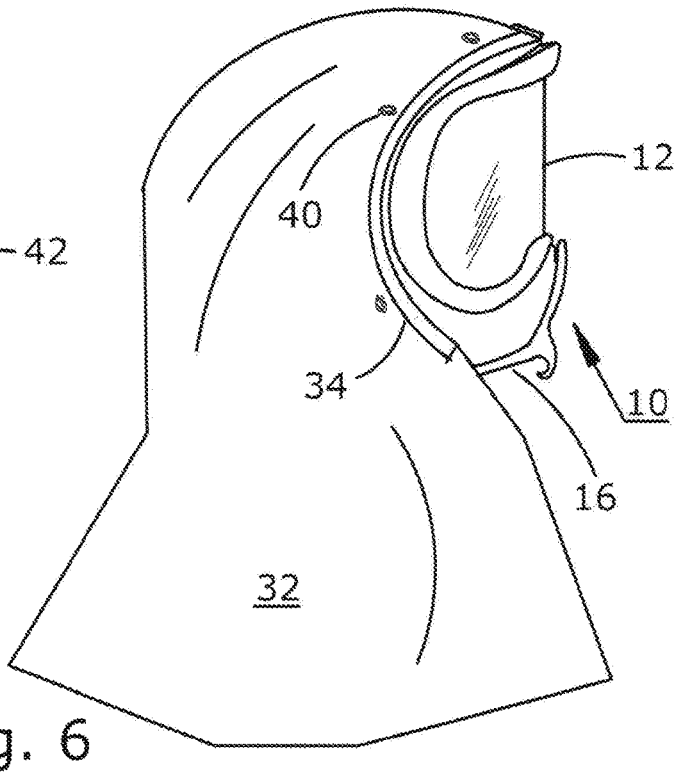
FIG. 6 is a side elevation view of a fully assembled hood and face mask according to the present invention.

Referring now to FIG. 6, hood 32 is seen as mounted to face mask 10. Fasteners 40 of hood 32 are engaged with fasteners 38 (see FIG. 4) of face mask 10, and lip 34 is in snug contact to intimately enclose flange 18. As noted above, in accordance with the present invention, hood 32 will preferably remain connected to face mask 10 while putting on and taking off the protective headgear. Fasteners 38, 40 are releasable to allow periodic removal of hood 32 from face mask 10 for cleaning or replacement.

Figure 7:
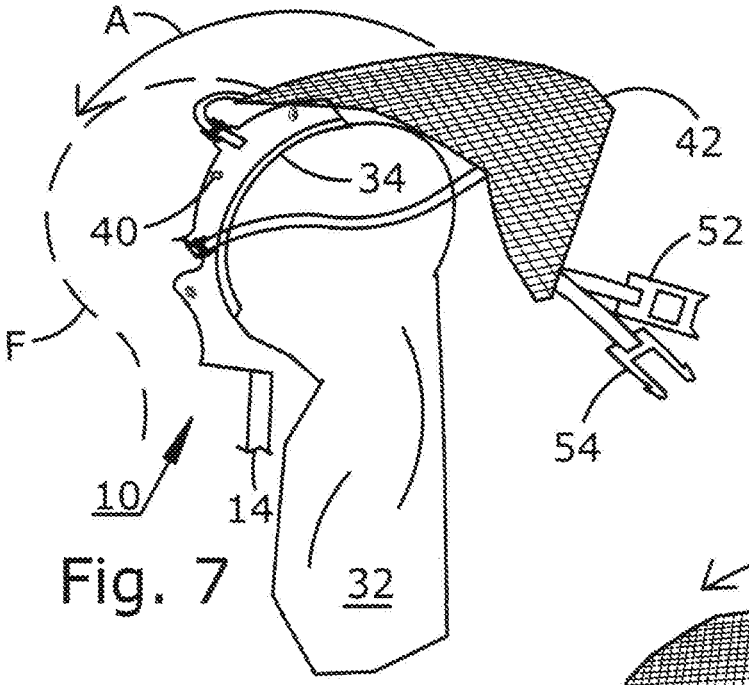
FIG. 7 is a side elevation view of the present invention headgear assembly with the face mask in position against the face of a firefighter with the hood hanging downward, the firefighter head shown in dashed lines.
Figure 8:
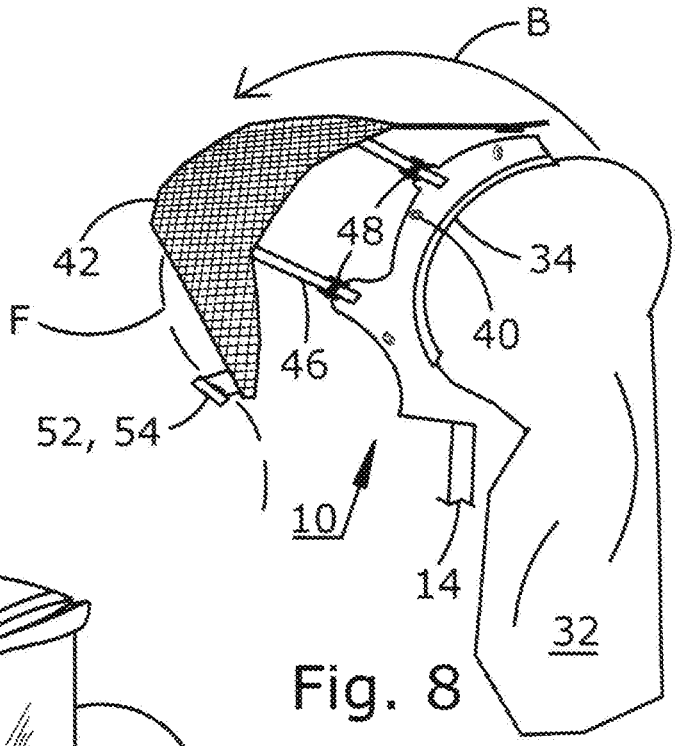
FIG. 8 is a side elevation view of the present invention headgear assembly with the face mask covering the firefighter's face, the cap behind the firefighter's head, and the hood hanging downward.
Figure 9:
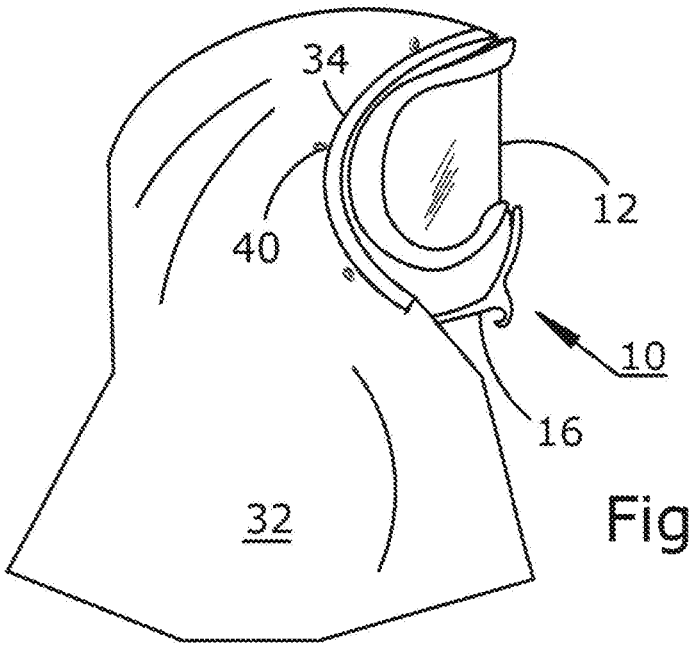
FIG. 9 is a side elevation view of the present invention headgear assembly fully covering the head of the firefighter.

FIGS. 7, 8 and 9 are presented to illustrate a sequence in which the firefighter puts on the fire protective headgear of the present invention. Referring now to FIG. 7, hood 32 is shown attached to face mask 10 by fasteners 40 and hanging downward in a position to block visor 12 (see FIG. 4). Cap 42 is positioned over face mask 10 and hood 32 with buckle set 52, 54 open. Face mask 10 is first placed against the face of a firefighter F, the head of firefighter F shown in dashed lines. Cap 42 is then moved in the direction indicated by arrow A.

Referring now to FIG. 8, once face mask 10 is in contact with the face of firefighter F, cap 42 has been brought from the position shown in FIG. 7 to cover the back of the head of firefighter F. Buckle set 52, 54 is fastened at the rear of the firefighter's head without the need to adjust the length of straps 46. Hood 32 remains mounted to face mask 10 by fasteners 40 and hangs downward, hood 32 being moveable in the direction indicated by arrow B.

Referring now to FIG. 9, the fire protective headgear of the present invention is shown in fully assembled condition with face mask 10 covering the face of a firefighter and hood 32 covering the back of the head. The lower portion of hood 32 covers the neck and shoulders and is to be subsequently overlaid by a fire protective jacket. Removing the fire protective headgear is readily accomplished by reversing the sequence shown in FIGS. 7, 8, and 9.

While the description above discloses a preferred embodiment of the present invention, it is contemplated that numerous variations and modifications of the invention are possible and are considered to be within the scope of the claims that follow.

What is claimed is:

1. Fire protective headgear, comprising:

a. a face mask having a transparent visor and a peripheral flange, the flange configured for conforming to the face of a firefighter;

b. a cap connected to the flange, the cap being formed with having a gap formed as an opening between lower side portions thereof;

c. a connectable closure having a first side in the form of a resilient spade mounted to one of the lower side portions of the cap and a second side in the form of a socket mounted to the other of the lower side portions of the cap; and d. a hood configured for engaging the flange and for covering the head and neck of a firefighter.

2. The fire protective headgear described in claim 1, wherein the hood is releasably engaged with the flange.

3. The fire protective headgear described in claim 1, wherein the flange is formed of a flexible material.

4. The fire protective headgear described in claim 1, further comprising a first series of fasteners mounted to the flange and a second series of fasteners mounted to the hood, the first and second fasteners configured to be releasably engaged with one another.

5. The fire protective headgear described in claim 4, wherein the first series of fasteners and the second series of fasteners are formed of a highly insulating and heat tolerant resin.

6. The fire protective headgear described in claim 5, wherein the highly insulating, heat tolerant resin is a high temperature nylon resin.

7. Fire protective headgear, comprising:

a. a face mask having a transparent visor and a flexible flange, the flange disposed along the periphery of the visor and configured for conforming to the face of a firefighter;

b. a series of first fastener components mounted to the flange;

c. a cap connected to the flange, the cap having a gap formed as an opening between lower side portions of the cap;

d. a connectable closure having a first side in the form of a resilient spade mounted to one of the lower side portions of the cap and a second side in the form of a socket mounted to the other of the lower side portions of the cap;

e. a hood configured for engaging the flange and for covering the head and neck of a firefighter; and f. a series of second fastener components mounted to the hood and being configured to be releasably engaged with the first fastener components.

8. The fire protective headgear described in claim 7, wherein the hood is releasably engaged with the flange.

9. The fire protective headgear described in claim 7, wherein the first series of fastener components and the second series of fastener components are formed of a highly insulating and heat tolerant material.

* * * * *